US006520838B1

(12) United States Patent
Shaw

(10) Patent No.: US 6,520,838 B1
(45) Date of Patent: Feb. 18, 2003

(54) SHIELDED SPIN POLISHING

(75) Inventor: James Stephen Shaw, Hampton Falls, NH (US)

(73) Assignee: General Electric Company, Schenectady, NY (US)

( * ) Notice: Subject to any disclaimer, the term of this patent is extended or adjusted under 35 U.S.C. 154(b) by 45 days.

(21) Appl. No.: 09/891,442

(22) Filed: Jun. 25, 2001

(51) Int. Cl.[7] ..... B24B 1/00

(52) U.S. Cl. ..... 451/38; 451/39; 451/82; 451/84; 451/457

(58) Field of Search ..... 451/38, 39, 40, 451/82, 84, 451, 457, 29

(56) References Cited

U.S. PATENT DOCUMENTS 2,542,955 A * 2/1951 Young et al.
3,691,691 A * 9/1972 Smith
4,769,956 A * 9/1988 Wern
4,974,375 A * 12/1990 Tada et al.
5,127,198 A * 7/1992 Nakayama et al.
5,129,198 A * 7/1992 Kanno et al.
6,183,347 B1 2/2001 Shaw

* cited by examiner

*Primary Examiner*—Eileen P. Morgan
(74) *Attorney, Agent, or Firm*—V. G. Ranaswamy; Francis L. Conte

(57) ABSTRACT

A shield is placed next to a workpiece to form a passage therebetween. The workpiece and shield are rotated, and a stream of abrasive shot is blasted toward the spinning workpiece and shield to periodically enter the passage to selectively abrade the workpiece.

22 Claims, 2 Drawing Sheets

SHIELDED SPIN POLISHING

BACKGROUND OF THE INVENTION

The present invention relates generally to machining metal, and, more specifically, to polishing thereof.

A gas turbine engine includes various compressor and turbine stator vanes and rotor blades. The vanes and blades have airfoil profiles specifically configured for use in compressing air or expanding hot combustion gases.

Accordingly, the airfoil profiles have three dimensional contours which vary from root to tip between leading and trailing edges over the opposite pressure and suction sides thereof. The airfoil has camber or arcuate curvature between its leading and trailing edges, with the pressure side typically being generally concave and the suction side typically being generally convex.

The airfoils may be made by various manufacturing processes. For example, some compressor airfoils are machined to size from metal blanks or forgings. Computer numerically controlled machines are commercially available for precisely controlling the position of a ball endmill tool over the complex three dimensional contour of the airfoil. Machining typically occurs by tracing the tool around the pressure and suction sides of the airfoil at a specific radial or span location, and then indexing the tool radially along the span for machining each radial section in turn from root to tip.

Since the ball endmill tool forms a small groove as it removes material around the circumference of the airfoil, adjoining grooves along the span of the airfoil have sharp ridges extending therebetween. After the machining process, these ridges must be removed to obtain an aerodynamically smooth surface finish without irregularity.

The ridges are typically removed by additional hand and machine polishing processes which increase the cost of manufacture thereof. Manual hand polishing uses grinders and buffers for removing a majority of the ridges. However, manual polishing is insufficient for meeting the required smooth finish requirements for the airfoil.

Mechanical polishing follows the hand polishing process in which a small batch of hand polished airfoils are tumbled in an abrasive bed in a vibratory finishing machine for achieving the desired smooth surface finish.

However, since a rotor blade airfoil typically includes an enlarged root end with an integral platform, the platform acts as an anchor in the polishing bed which results in directional polishing along the span or longitudinal axis of the airfoil.

These multiple steps in polishing the machined airfoils increase the time of manufacture and corresponding cost thereof for achieving the desired smooth airfoil surface devoid of ridges and grooves.

Accordingly, it is desired to provide a new process for polishing workpieces, such as machined airfoils, with improved effectiveness and decreased cost.

BRIEF SUMMARY OF THE INVENTION

A shield is placed next to a workpiece to form a passage therebetween. The workpiece and shield are rotated, and a stream of abrasive shot is blasted toward the spinning workpiece and shield to periodically enter the passage to selectively abrade the workpiece.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
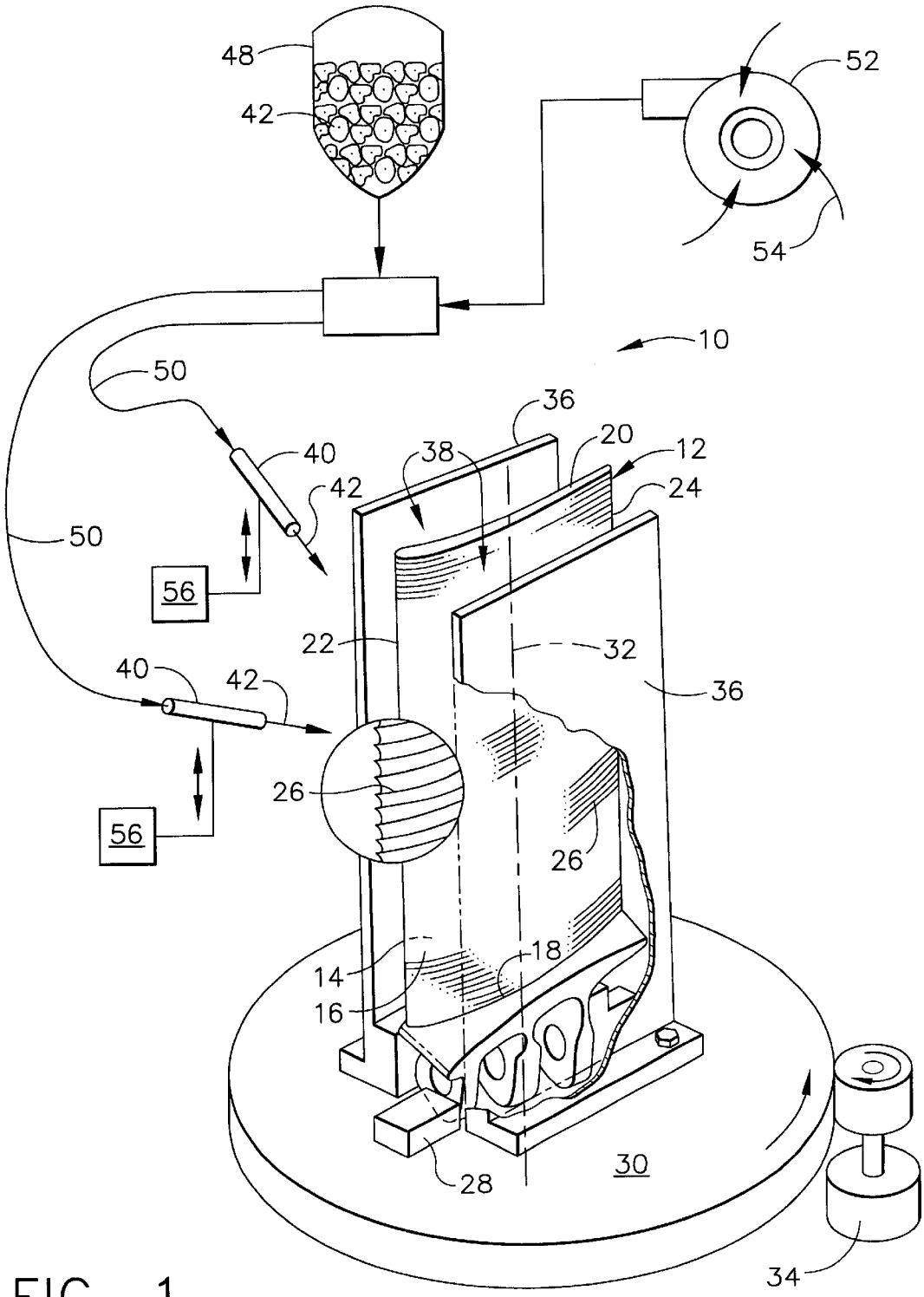
FIG. 1 is a schematic representation of an apparatus and method for spin polishing a shielded workpiece in accordance with an exemplary embodiment of the present invention.

Illustrated schematically in FIG. 1 is an apparatus 10 for polishing a workpiece 12 in accordance with an exemplary embodiment of the present invention. The workpiece may have any suitable form, such as the airfoil portion of a gas turbine engine compressor rotor blade having a mounting dovetail at one end thereof.

The airfoil 12 has opposite pressure and suction sides 14,16 which extend radially in span from a root 18 at an inner flowpath platform to a radially outer tip 20. The pressure and suction side surfaces extend axially between opposite leading and trailing edges 22,24 which are relative to the direction of airflow when used in a gas turbine engine compressor.

The airfoil typically has camber which is arcuate curvature between the leading and trailing edges which may vary from root to tip as the airfoil varies in twist angle according to the specific configuration thereof. The pressure side 14 is typically concave axially between the leading and trailing edges, with the suction side 16 typically being convex.

As indicated above, the airfoil is typically manufactured using a multi-axis numerically controlled machining tool having a ball endmill tool (not shown) which is traced along both sides of the airfoil for achieving the desired aerodynamic profile thereof. The tool is indexed from root to tip and forms a series of longitudinally or radially adjoining grooves having sharp ridges 26, shown magnified in part in FIG. 1 for clarity of presentation. The ridges typically extend axially between the leading and trailing edges and are spaced apart along the span of the airfoil corresponding with the stacking axis thereof.

The apparatus 10 illustrated in FIG. 1 is specifically configured for practicing a new method of abrading the ridges 26 for polishing the airfoil to an aerodynamically smooth and shiny surface finish without irregularities therein which would compromise aerodynamic performance.

More specifically, an individual airfoil 12 is mounted in a suitable fixture 28 atop a rotary platter or turntable 30. The airfoil is preferably mounted with its stacking axis coincident with a spinning axis 32 which extends through the center of the turntable. In this way, the airfoil is rigidly clamped to the turntable for rotation or spinning about its center spinning axis.

The turntable is operatively joined to a suitable motor 34 effective for rotating the turntable at any desired rotational speed.

A pair of side shields 36 are fixedly mounted to the turntable on opposite sides of the airfoil for rotation therewith. Each shield is placed next to the corresponding side of the airfoil to form a passage or channel 38 therebetween.

Means including a discharge nozzle 40 are provided for blasting a stream of abrasive shot 42 toward the airfoil for abrasive polishing thereof. During the polishing process, the motor 34 is operated to rotate the turntable 30 and in turn rotate and spin together the airfoil 12 with its protective side shields 36. As the airfoil and shields spin, the shot stream is aimed or directed at the workpiece and periodically enters the side passages 38 for abrading selective portions of the opposite sides spinning within the impact site of the shot stream.

One of more of the discharge nozzles 40 may be used for blasting the shot against the workpiece, with the shields permitting only shallow impingement of the shot against the opposite airfoil sides as opposed to generally perpendicular impingement. Since the shot is abrasive, abrasion and polishing of the airfoil may be controlled by controlling the impingement or incident angle of the shot against the airfoil surfaces.

Figure 2:
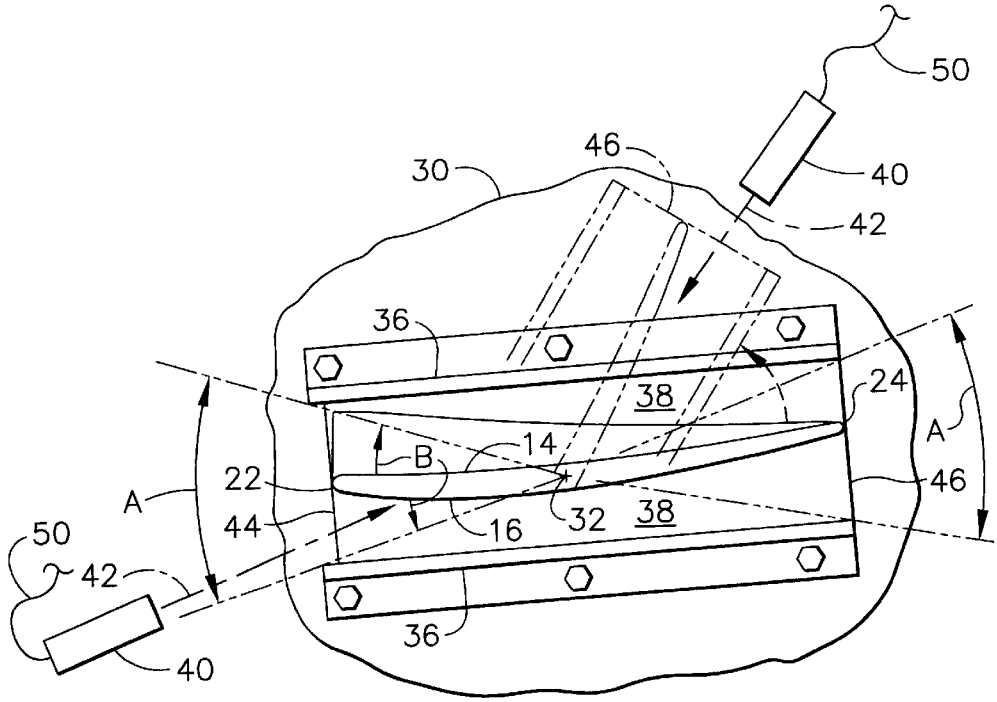
FIG. 2 is a top view of the shielded workpiece illustrated in FIG. 1 which is rotated about a central spinning axis thereof for abrasive polishing the opposite sides thereof.

More specifically, and as shown in more detail in FIG. 2, each of the two shields 36 is placed radially outwardly from the spinning axis 32 to form forward and aft apertures or windows 44,46 at opposite ends of the respective passages 38. The nozzle 40 is held substantially stationary in space relative to the rotating turntable 30 so that as the turntable spins the opposite windows 44,46 each face the discharge end of the nozzle once per revolution for permitting corresponding periodic abrasion of the airfoil.

In this way, the shot stream is blasted periodically through the forward windows 44 permitting access to the opposite sides of the airfoil at the leading edge, and then through the aft windows 46 permitting access of the shot stream to the opposite sides of the airfoil at the trailing edge.

By placing the pair of shields 36 on respective opposite sides of the airfoil, a pair of the access passages 38 with corresponding forward and aft windows 44,46 are created. Accordingly, as the workpiece spins during the polishing process, the shot stream is blasted alternately through the forward and aft windows to abrade and polish both sides of the airfoil from opposite ends thereof during each revolution. In each revolution, therefore, the airfoil 12 may be polished along both sides thereof as the shot stream flows past the spinning leading and trailing edges 22,24.

Since the airfoil 12 is a slender or thin member having a chord length many times greater than the maximum thickness thereof, the two side shields 36 may be used to advantage to both preferentially protect the opposite sides of the airfoil while permitting selective polishing thereof at shallow impingement angles controlled by the opposite forward and aft access windows 44,46.

In an alternate embodiment, either side of the airfoil may be protected from polishing by a suitable cover thereover such as mounting one of the side shields directly against the airfoil side, with polishing performed on only one side thereof using a corresponding side shield space therefrom. One side polishing in this manner may be desirable for other workpiece configurations, whereas the airfoil configuration is preferably polished along both sides using the pair of side shields for this purpose.

Figure 3:
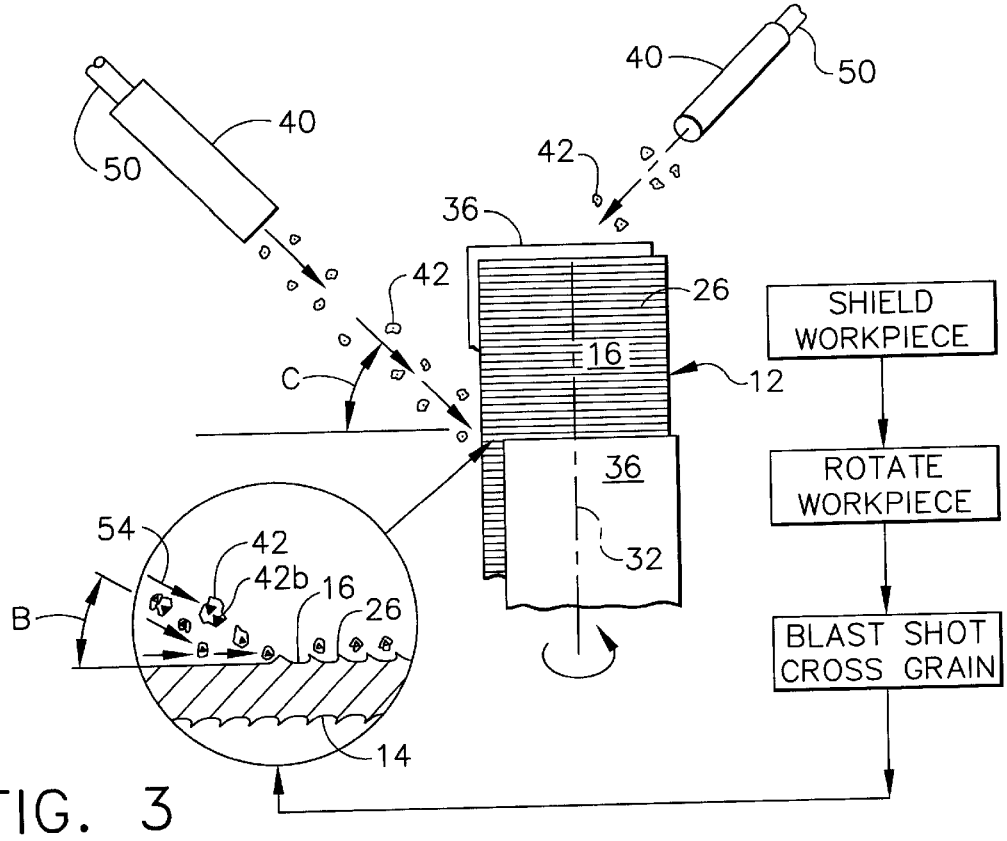
FIG. 3 is a schematic elevational view of the workpiece and polishing apparatus illustrated in FIG. 1, with a flowchart representation of an exemplary method of polishing.

Although various forms of abrasive shot may be used, in the preferred embodiment illustrated in the figures the shot 42 is resilient or pliant for controlled selective abrasion. As shown in FIG. 3, the shot is preferably a cellular polyurethane sponge with imbedded abrasive particles 42*b*. This form of pliant shot has substantial advantages in selectively abrading the intended ridges from the airfoil surfaces while protecting from excessive abrasion the resulting smooth surfaces formed during the polishing process.

More specifically, the present invention is one of a series of inventions specifically configured for using the abrasive characteristics of the pliant shot. In U.S. patent application Ser. No. 09/358643 a process for Sustained Surface Scrubbing is disclosed in which pliant shot is blasted over a workpiece surface for selectively abrading protrusions thereon with little, if any, abrasion of the adjoining flat surfaces.

In that process, shallow incidence angles of impingement including 30° and 45° and up to about 60° to the flat workpiece surface results in scrubbing of the pliant shot along the flat surface with little significant abrasion thereof, but with substantial abrasion of protrusions such as burrs or sharp edges extending normally to the flat surface. Impingement angles greater than about 60°, including perpendicular impingement, are undesirable for their excessive abrasion effect as well as the possibility of imbedding abrasive particles into the metallic surface being treated.

As illustrated in FIG. 3, the preferred form of the pliant shot 42 is a light-weight, resilient material such as a sponge, rubber, felt, plastic, foam, or other resilient material. The shot may have open or closed cells. The shot preferably includes the abrasive particles 42*b* imbedded therein, although in alternative embodiments abrasive may be omitted. Suitable abrasives include particles of various minerals, metal oxides, plastics, and black walnut shell, for example.

One type of suitable pliant shot is commercially available from Sponge-Jet Inc. of Eliot, Maine under the tradename of Sponge Media. This sponge media includes a polyurethane open-cell carrier in which is impregnated different types of abrasive material for different abrasive performance. And, one form of the sponge media is without abrasive.

Equipment for discharging the pliant shot is also commercially available from Sponge Jet Inc., but is modified and operated differently for the purposes of the present invention. In conventional practice, the sponge media is blasted generally perpendicularly against a surface of a workpiece for removing coatings thereof while profiling the underlying surface for improving adherence to replacement coatings.

However, the pliant shot disclosed above is used for selectively abrading the ridges 26 to polish the airfoil sides for meeting the precise dimensional sectional profiles thereof.

The blasting apparatus illustrated in FIG. 1 is conventional in structure and includes a hopper 48 in which the pliant shot 42 is stored. The hopper is joined in flow communication with a respective delivery conduit or hose 50 extending to each of a pair of the nozzles 40.

An air compressor or pump 52 is operatively joined to the hopper and hoses by a suitable mixing device for providing air as a carrier fluid 54 under suitable pressure for carrying and discharging the shot in a stream through the respective nozzles 40. The nozzles may have any suitable configuration for discharging the shot in a suitably wide stream for decreasing overall processing time.

As initially illustrated in FIG. 2, the two side shields 36 are positioned generally parallel to the opposite sides of the airfoil and extend from leading to trailing edges thereof to provide the forward and aft windows 44,46 general coplanar with the corresponding leading and trailing edges 22,24 of the airfoil. In this way, as the workpiece and shields rotate together on the turntable, the side shields prevent the shot stream from impinging the sides of the airfoil at large incidence angles approaching perpendicular, while permitting impingement at the desired shallow angles of incidence.

The width of the side shields illustrated in FIG. 2 along with their spacing from the opposite sides of the airfoil control the total angular range A of impingement or incidence angles at which the shot impinges the sides of the airfoil from either the leading or trailing edges thereof. The total range A of incidence angles is a cone corresponding with the angular extent that the forward or aft windows face the corresponding nozzle during spinning of the airfoil through which windows the pliant shot may impinge the airfoil surfaces. The individual shields therefore act as shutters which rotate into position to temporarily block the shot stream from impinging the airfoil over a majority of the 360° motion of the airfoil in each revolution.

As the airfoil spins during the polishing process, the instantaneous angle of incidence B correspondingly varies from about 0° when either the leading and trailing edges are aligned with the shot stream to a maximum angle of incidence at the outer extremes of the two windows just as the shields enter the shot stream and interrupt the flow thereof to the corresponding sides of the airfoil.

The preferred shallow angle of incidence B is illustrated in more detail in FIG. 3 and is preferably less than or equal to about 45°. Correspondingly, the two side shields 36 extend in width and spacing from the opposite sides of the airfoil to shield those sides from the shot stream at incidence angles greater than about 45°. In this way, the stream of shot 42 impinges the airfoil sides at shallow angles in the carrier air 54. As the shot impinges the protruding ridges, substantial abrasion thereof occurs until the ridges are removed.

Without the ridges, the airfoil sides become smooth and further impingement by the pliant shot merely scrubs along the surface without appreciable further abrasion thereof. The abrasion or polishing effect is thereby self-limiting and substantially ends upon removal of the ridges notwithstanding the continuing stream of shot. The shot is resilient and compresses upon impingement for protecting flat surfaces yet is effectively abrasive upon impinging protruding surfaces such as the ridges.

In the exemplary embodiment illustrated in FIG. 3 the ridges 26 extend substantially perpendicular or normal to the longitudinal spinning axis 32. In order to maximize the abrasion thereof, the shot stream 42 is preferably aimed obliquely to the ridges 26 in a cross grain orientation. In FIG. 3, the grain of the ridges is horizontal and the nozzle 40 is preferably inclined at an oblique inclination angle C for directing the shot obliquely across the ridge grain.

Since the airfoil 12 spins during the polishing process, the pliant shot 42 from the corresponding nozzle 40 impinges the ridges obliquely thereto at both leading and trailing edges of the airfoil in each revolution.

Note the distinction between the surface incidence angle B in the radial section illustrated in FIG. 2 and the ridge incidence angle C in the span plane illustrated in FIG. 3. The shot reception cone angle A in FIG. 2 is limited; with the spinning side shields 36 periodically interrupting the shot stream from engaging the workpiece.

The ridge incidence angle C in FIG. 3 permits cross grain abrasion of the ridges and is held constant as the airfoil spins relative to the nozzle. And, in each revolution of the airfoil, the ridges are abraded in opposite cross grain directions on each side of the airfoil as the leading edge and trailing edge of the airfoil are sequentially rotated within the impingement zone of the corresponding nozzle.

In the preferred embodiment illustrated in FIGS. 1 and 2, two of the nozzles 40 are used for blasting a pair of the shot streams 42 toward the rotating airfoil and protective shields at different orientation angles around the spinning axis. As shown in FIG. 2, the two nozzles 40 are oriented obliquely from each other, but preferably not diametrically opposite to each other, so that the common airfoil 12 may be polished by multiple shot streams in each revolution of the airfoil.

However, only one shot stream is permitted to enter the windows at any one time during rotation of the airfoil in this preferred configuration to prevent collision of the two streams. The shot streams thusly alternately enter the passages 38 during spinning of the airfoil and increase the total rate of ridge abrasion.

As shown in FIG. 3, the two nozzles 40 may both be oriented with the common ridge incidence angle C for maximizing cross grain abrasion of the ridges.

Irrespective of the circumferential location of the individual nozzles 40 around the spinning axis 30, each nozzle still enjoys the benefit of the limited surface incidence angle A for effecting the selective surface scrubbing or abrasion of protrusions, such as the ridges, without significant abrasion of adjoining flat or smooth surfaces as they are formed.

A particular advantage of the two nozzles 40 illustrated in FIG. 2 is the ability to improve the polishing process of an arcuate workpiece such as the airfoil. The airfoil has camber or curvature between its leading and trailing edges which may be substantial in defining the concave pressure side and convex suction side. Since the suction side is convex, the incident shot stream illustrated in FIG. 2 may cause a shadow region on the downstream sides of the convex surface in which little if any abrasion of the ridges occurs.

However, by correspondingly aiming the two nozzles 40 at different orientations for the airfoil suction side, the corresponding shot streams may more effectively abrade the ridges from the opposite edges of the airfoil in the respective shadow regions due to the opposite nozzle and the camber of the airfoil. Accordingly the leading edge portion of the airfoil and trailing edge portion of the airfoil are best polished from the corresponding shot streams as they enter the respective forward or aft windows 44,46.

The individual nozzles 40 illustrated in FIG. 2 may be suitably sized to discharge the stream of pliant shot 42 with a sufficient width fitting within the maximum width of the individual forward and aft windows 44,46. In this way, the ridges may be abraded from the leading edge 22 to the midchord region in the airfoil forward portion when the shot enters the forward windows, and the aft portion of the airfoil is abraded from the trailing edge to the midchord when the shot enters the aft windows.

As shown in FIG. 3, the shot is also directed preferably downwardly at the cross grain inclination angle C with the abrasive effect of the shot extending over a finite portion of the radial span of the airfoil. In this way, a radial band of the airfoil may be effectively polished for each radial position of the corresponding nozzles 40.

As shown in FIG. 1, the nozzles 40 are preferably mounted to suitable translation carriages 56 mounted next to the turntable 30 for automatically moving the nozzles along the span length of the airfoil so that all radial sections of the airfoil from root to tip may be automatically polished. In the preferred embodiment, the airfoil spins on the turntable 30 as the two nozzles 40 slowly move radially back and forth between the root and tip of the airfoil for removing all of the ridges from root to tip of the airfoil and leaving a smooth and polished surface.

In a single operation, therefore, an individual airfoil may be polished on both sides for removing the ridges therefrom. The polishing operation is effectively self-terminating since once the ridges are removed, the remaining surface is smooth and subject to little, if any more, additional abrasion from the pliant shot impinging the smooth surface at shallow incidence angles. The resulting airfoil profile may be precisely controlled in dimensions for maximizing aerodynamic performance.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly,

What is desired to be secured by Letters Patent of the United States is the invention as defined and differentiated in the following claims in which I claim:

1. A method of polishing a workpiece comprising:

placing a shield next to said workpiece to form a passage therebetween;

spinning said workpiece and shield around a spinning axis extending through said workpiece; and blasting a stream of abrasive shot toward said spinning workpiece and shield to periodically enter said passage to abrade said workpiece.

2. A method according to claim 1 further comprising:

placing said shield radially outwardly from said spinning axis to form forward and aft windows at opposite ends of said passage; and blasting said shot stream alternately through said forward and aft windows to abrade said workpiece from opposite ends during spinning thereof.

3. A method according to claim 2 further comprising:

placing a pair of said shields on opposite sides of said workpiece to form a pair of said passages with corresponding forward and aft windows; and blasting said shot stream alternately through said forward and aft windows to abrade said opposite sides of said workpiece during spinning thereof.

4. A method according to claim 3 further comprising spacing said shields from said workpiece to shield said workpiece opposite sides from incidence angles of said shot stream greater than about 45°.

5. A method according to claim 3 wherein said opposite sides of said workpiece include machining ridges extending substantially perpendicular to said spinning axis, and further comprising aiming said shot stream obliquely to said ridges.

6. A method according to claim 5 wherein said shot stream is aimed at about 45° toward said ridges.

7. A method according to claim 5 further comprising blasting a pair of said shot streams toward said rotating workpiece and shields at different orientation angles around said spinning axis to alternately enter said passages during spinning of said workpiece.

8. A method according to claim 7 wherein said workpiece comprises an airfoil having camber, and said pair of shot streams are aimed at different orientations to abrade said ridges from opposite edges of said workpiece in shadow regions caused by said camber.

9. A method according to claim 5 wherein said shot is pliant.

10. A method according to claim 9 wherein said shot comprises cellular polyurethane sponge with imbedded abrasive particles.

11. An apparatus for polishing a workpiece comprising:

a shield mounted to a turntable, said turntable for supporting said workpiece next to said shield to form a passage therebetween;

means for spinning said turntable around a spinning axis extending through said workpiece; and means for blasting a stream of abrasive shot toward said spinning workpiece and shield to periodically enter said passage to abrade said workpiece.

12. An apparatus according to claim 11 wherein:

said turntable includes a fixture to mount said workpiece at said spinning axis extending through said workpiece and turntable;

said shield is positioned radially outwardly from said spinning axis to form forward and aft windows at opposite ends of said passage; and said blasting means are effective for blasting said shot stream alternately through said forward and aft windows to abrade said workpiece from opposite sides during spinning thereof.

13. An apparatus according to claim 12 further comprising:

a pair of said shields mounted to said turntable to form a pair of said passages on opposite sides of said workpiece with corresponding forward and aft windows; and said blasting means are configured to blast said shot stream alternately through said forward and aft windows to abrade said opposite sides of said workpiece during spinning thereof.

14. An apparatus according to claim 13 further comprising spacing said shields from said workpiece to shield said workpiece opposite sides from incidence angles of said shot stream greater than about 45°.

15. An apparatus according to claim 14 wherein said shot is pliant.

16. An apparatus according to claim 15 wherein said shot comprises cellular polyurethane sponge with imbedded abrasive particles.

17. A method of polishing an airfoil to remove machining ridges from opposite sides thereof comprising:

placing a pair of shields on opposite sides of said airfoil to form corresponding passages therebetween;

spinning said airfoil and shields; and blasting a stream of abrasive pliant shot toward said spinning airfoil and shields to periodically enter said passages to impinge said ridges for abrasion thereof.

18. A method according to claim 17 further comprising:

spinning said airfoil around a spinning axis extending therethrough;

placing said shields radially outwardly from said spinning axis to form forward and aft windows at opposite ends of said passages; and blasting said shot stream alternately through said forward and aft windows to abrade said ridges from opposite ends of said airfoil during spinning thereof.

19. A method according to claim 18 further comprising:

spacing said shields from said airfoil to shield said airfoil opposite sides from incidence angles of said shot stream greater than about 45°; and aiming said shot stream obliquely to said ridges.

20. A method according to claim 19 wherein said machining ridges extend substantially perpendicular to said spinning axis, and further comprising aiming said shot stream at about 45° toward said ridges.

21. A method according to claim 20 wherein said airfoil has camber, and further comprising blasting a pair of said shot streams toward said rotating airfoil and shields at different orientation angles around said spinning axis to alternately enter said passages during spinning of said airfoil to abrade said ridges from opposite edges of said airfoil in shadow regions caused by said camber.

22. A method according to claim 21 wherein said shot comprises cellular polyurethane sponge with imbedded abrasive particles.

* * * * *